US005135206A

United States Patent [19]

Martinez

[11] Patent Number: 5,135,206

[45] Date of Patent: Aug. 4, 1992

[54] ROUTABLE STOCK CLAMPING DEVICE

[76] Inventor: Ramiro H. Martinez, Citrus Heights, Calif.

[21] Appl. No.: 698,825

[22] Filed: May 13, 1991

[51] Int. Cl.[5] ..... B25B 3/00

[52] U.S. Cl. ..... 269/21; 269/41; 29/281.1

[58] Field of Search ..... 269/41, 43, 45, 21, 269/296, 254 R; 29/281.1

[56] References Cited

U.S. PATENT DOCUMENTS

| | | | |
|---|---|---|---|
| 842,007 | 1/1907 | Parker | 269/45 |
| 3,394,389 | 7/1968 | Amir | 269/45 |
| 4,058,281 | 11/1977 | Albert | 269/21 |
| 4,497,476 | 2/1985 | Wiele | 269/21 |
| 4,615,073 | 10/1986 | Haak | 269/45 |

FOREIGN PATENT DOCUMENTS

| | | | |
|---|---|---|---|
| 276097 | 7/1914 | Fed. Rep. of Germany | 269/41 |
| 1296743 | 5/1962 | France | 269/45 |

*Primary Examiner*—J. J. Hartman

*Attorney, Agent, or Firm*—Mark C. Jacobs

[57] ABSTRACT

A clamping device for use with stock to be adhesed into a position where it will be routed to form a cove or other shaped routed joint at the interface of a vertical and a horizontal surface of Corian TM or equal rigid plastic sheets typically at the junction of a countertop and a backsplash respectively for kitchens and bathrooms. The device includes a main body having a pair of spaced suction cups at opposite ends of the main body portion. Each of the suction cups is disposed on an extremity or terminal section of the central section of the main body at a similar but oppositely directed angle relative to the central section of the main body portion. The central section also includes a spring-loaded retaining notch disposed therethrough at about the midpoint of the central section for the stock to be routed.

7 Claims, 3 Drawing Sheets

ROUTABLE STOCK CLAMPING DEVICE

BACKGROUND OF THE INVENTION

Architects, kitchen designers and homeowners all strive to achieve aesthetic counters, which are at the same time highly functional and which require minimum maintenance. The so-called high tech look is achieved by using "solid surface materials", for example Corian TM or Formica 2000X TM materials among others for counter construction. Counters comprise countertops which are horizontal surfaces located in kitchens and bathrooms and which generally have a backsplash or vertical wall surface that interfaces with the countertop at 90 degrees. One of the problems that can arise is that dirt and moisture can get into the space at the junction of the two intersecting members or panels which meet at the 90-degree angle. It has been found, that dirt and contamination and house setting separation problems can be overcome by interposing a length of similar material, (such as Corian TM and the like,) to the countertop which length can be routed or shaped to a configuration pleasing to the eye. The most common shape utilized at the interface of the vertical and horizontal surfaces, is an inside 90-degree curve also know as a cove corner which creates a flowing one piece vertical-horizontal appearance. Indeed, one finds available in the marketplace special tools used in a setup unlike what one would anticipate. That is, the backsplash or vertical wall section does not come all the way down to meet the horizontal countertop. Rather, cove stock is interposed in the space between the vertical wall section and the horizontal countertop. And this cove stock is then cut to shape after being glued in place with a suitable adhesive. Many problem arise from the use of this current technology. The primary complaint is the excessive time that it takes to cove such stock to complete the enhancement of an average-size kitchen's countertops and backsplashes. And as it is, the ultimate appearance could be improved. Also, it is difficult sometimes to cut the vertical material to exact size such that the cove will readily fit within the gap or space between the lower extreme of the vertical member and the upper surface of the countertop.

There is therefore a need for a method that will increase the speed of the craftsman in preparing a coved edge interface of a section of kitchen counters, bathroom vanities and shower wall corners and their interface of walls with shower pans. And, there is also a need for a tool that will permit him to easily carry out the coving procedure.

It is an object therefore of this invention to provide a novel clamping device for use in the routing procedure for the enhancement of kitchen and bath countertops among others.

It is another object to provide a device that permits the use of a different method of preparing a cove corner along a section of kitchen or bath countertops.

It is yet another object to provide a low cost easy to make cove or other routable shape stock, retaining means.

It is yet another object to provide a glue clamp for "solid surface" materials.

These and other objects of the invention will in part be obvious and will in part appear hereinafter.

The invention accordingly comprises the product possessing the features, properties and the relation of components which are exemplified in the following detailed disclosure and the scope of the application of which will be indicated in the claims.

For a fuller understanding of the nature and objects of the invention reference should be made to the following detailed description taken in conjunction with the accompanying drawings.

SUMMARY OF THE INVENTION

A clamping device for retaining cove or other stock in place such that it can be adhesed in abutment with similar materials prior to being routed. The cove stock is intended for use at the interface of a vertical backsplash and a countertop one or both of which are made of Corian TM or similar material. The cove stock also of Corian TM is retained in place during a gluing step, such that it can be routed by a shaper, router, plane or other suitable tool, upon removal of the clamp(s).

DESCRIPTION OF THE PREFERRED EMBODIMENT

Figure 1:
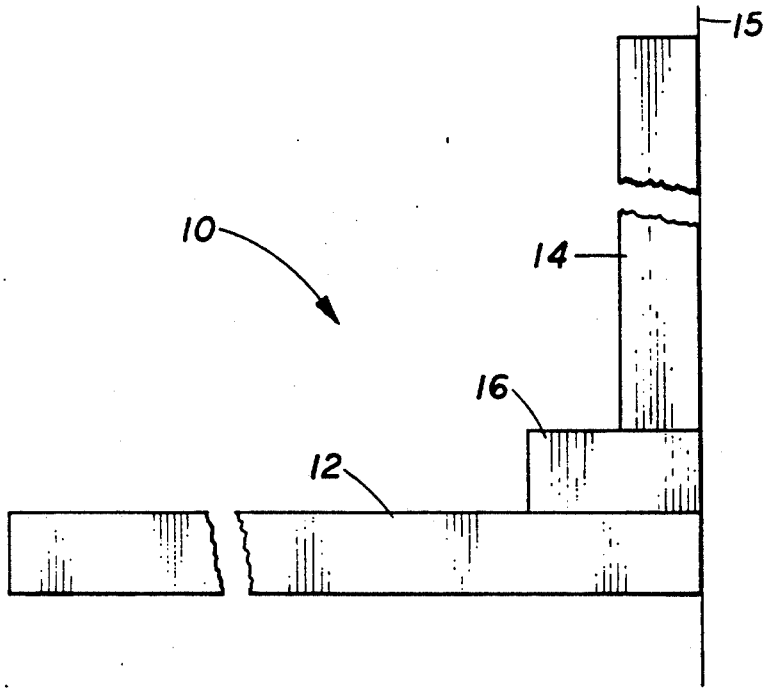
FIG. 1 is an sectional view illustrating prior art panel placement for preparing coved corner countertop-backsplash interfaces.

FIG. 1 depicts the prior art mode of interface construction technique conventionally employed in the formation of a coved interface between a backsplash and a countertop. Construction mode 10 is seen to provide for the interposition of a coveable member 16 between (emphasis added) the horizontal countertop 12 and a spaced, normally disposed, vertical backsplash 14. That is, the backsplash does not abut the countertop 12, rather it stops short and the coveable member 16, sized to friction fit between the elements 12 and 14 is interposed against the wall 15, glued in place and then subjected to the action of a router to prepare the cove interface.

Figure 5:
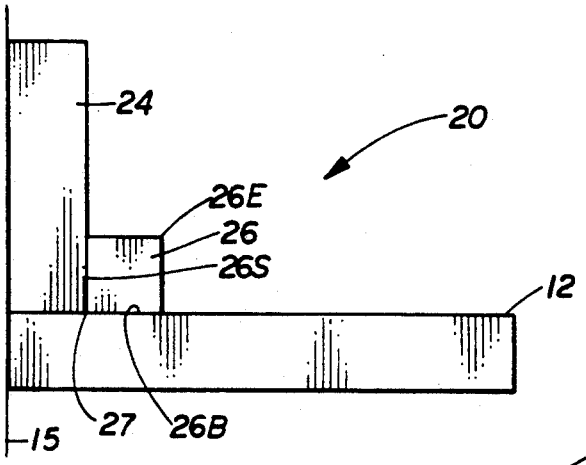
FIG. 5 is a sectional view illustrating panel placement according to this invention for the preparation of coved corner countertop-backsplash interfaces.

The prior art technique 10 is to be compared to the present new technique illustrated in FIG. 5 and labeled 20. Here the countertop is still 10 since it is the same and its positioning against the wall 15 is the same as in the prior art. However the backsplash is now designated 24 since it comes down to and abuts countertop 10. Coveable stock 26, rather than being rectangular and interposed as is coveable member 16 in prior art mode 10, is square and abutting for countertop 10 and backsplash 24. Coveable stock 26 is seen to be glued in place along one of its bases 26B and one of its side walls 26S to the backsplash 24 and the countertop 10 at the corner 27 where they meet. This figure constitutes the BEFORE aspect of the process of this invention, while FIG. 7 represents the AFTER aspect in that coveable stock 26 is seen after it has been routed to achieve the coved effect and thus the designation 26C. DLI and DL2 are the dotted lines which represent the adhesed connections of coveable stock 26's walls 26S and 26B that are adhesed to the backsplash and countertop respectively. Details on the achievement of this coved appearance will be described infra. The ability to employ the technique shown in FIG. 6 to reach the results of FIG. 7, can only be achieved, it is believed when the skilled artisan utilizes the clamping tool of this invention to retain the coveable stock 26 in place for it to be routed.

Figure 2:
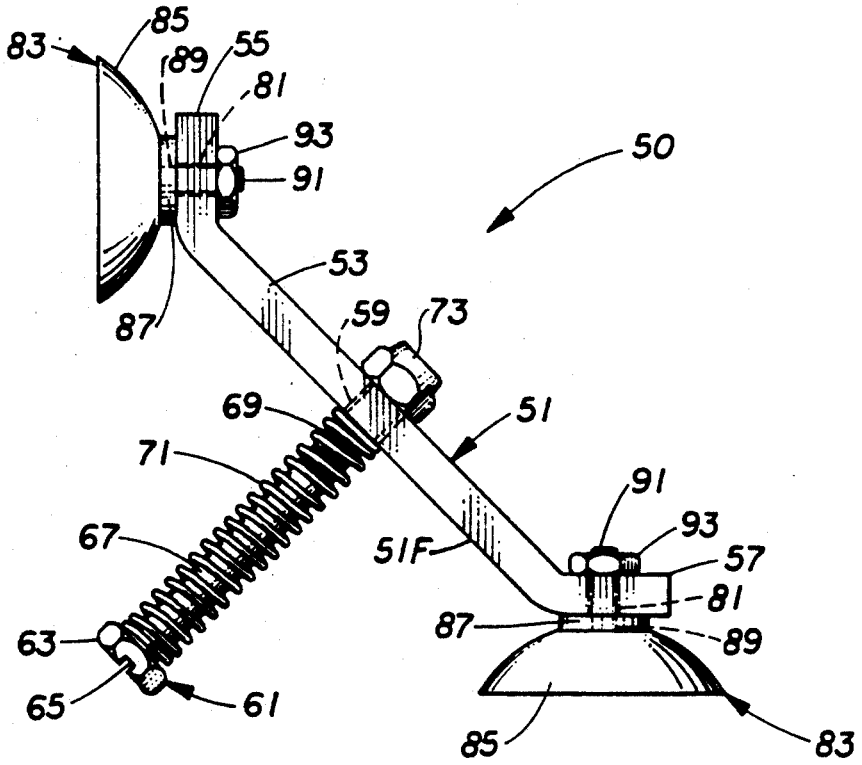
FIG. 2 is a left side elevational view of the clamping device of this invention. (The right side elevation is a mirror image thereof).

Therefore the reader's attention is now turned to FIG. 2 wherein there is depicted the clamping device of this invention. Device 50 is seen to include a main body 51 having a central section 53 and first and second extremities 55 and 57, each of which is disposed at a mirrored 45 degree angle inwardly directed relative to the plane of the central section 53, and at a 90 degree angle relative to each other. These extremities are also referred to as terminal sections. This 45 degree angle may be varied to suit the situation. Thus, if the angle between the two panels to receive a routed interface is 60 degrees, then each terminal section should be disposed at ½ of the 60 degrees or 30 degrees relative to the central section.

A central throughbore is provided along the length of the central section 53 for reasons to be discussed. Preferably the main body is formed as by injection molding as a unitary structure to include the central section and the two extremities. Typically the central section is about 3 inches long, with each extremity being about 1 inch long. The suggested thickness is about 0.25 inches. Suitable materials include aluminum or steel or rigid plastics such as but not limited to acrylic, nylon, or ABS among others.

Disposed through the central bore 59 is a threaded bolt 61 having a head 63 which may be square or a hexagonal configuration, and having a slot 65 therein. Bolt 61 has a shaft 67, which is the part that in fact actually protrudes through central bore 59. Bolt 61 has threads 69 at least at its terminal end. A nut 73 is secured to the threads 69 of bolt 61.

The diameter of central bore 59 is such that even the threads 67 of the bolt 61 will pass therethrough. Disposed along the shaft of the bolt 61 between head 63 and bore 59 is a coil spring 71. This spring 71 in relaxed position urges the head 63 away from the main body 51.

Each extremity or terminal section 55, 57 includes a throughbore 81. A suction cup 83 having a concave force cup 85 and a conventional cylindrical head 87 is disposed in impingement upon each extremity 55, 57 on the front side 51F of the device. The bolt head 63 is also disposed on this front side of the device. Cylindrical head 87 of the suction cups 85 includes an internal bore 89 into which is adhesed or . otherwise secured a terminally threaded shaft 91 of an extension greater than the depth of the bore 89, i.e., shaft 91 extends out of the bore 89, and through the throughbore 8I. A nut 93 secures shaft 91 and the entire suction cup 83 into place. Typically the diameter of the force cup at its impinging edge is about 1 inch. The force cup is preferably made of rubber or a flexible plastic.

Figure 3:
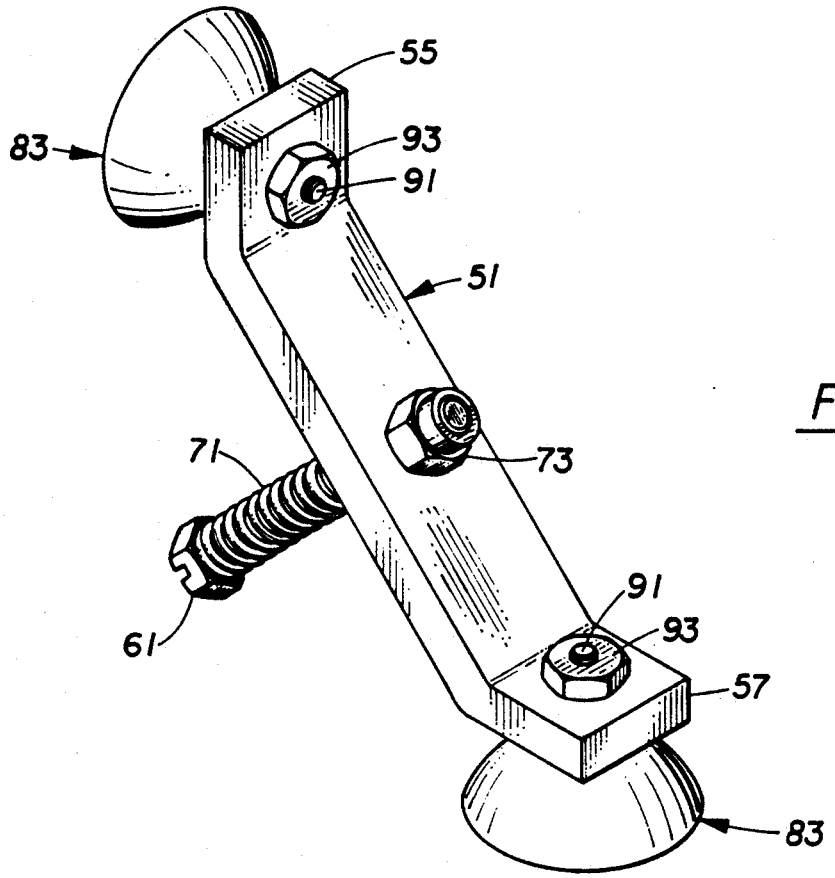
FIG. 3 is a rear perspective view thereof.
Figure 4:
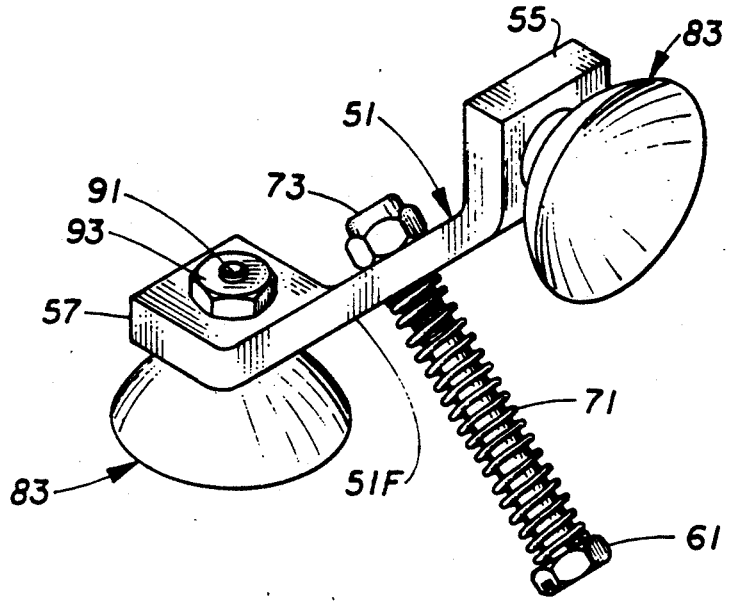
FIG. 4 is a front perspective view of the device of this invention.

FIG. 3, a rear perspective view is presented to help illustrate how the suction cup 83 is attached to the main body portion 51. Since all parts have been discussed, the presence of FIG. 4 is seen to be to add clarification for the benefit of the reader.

Figure 6:
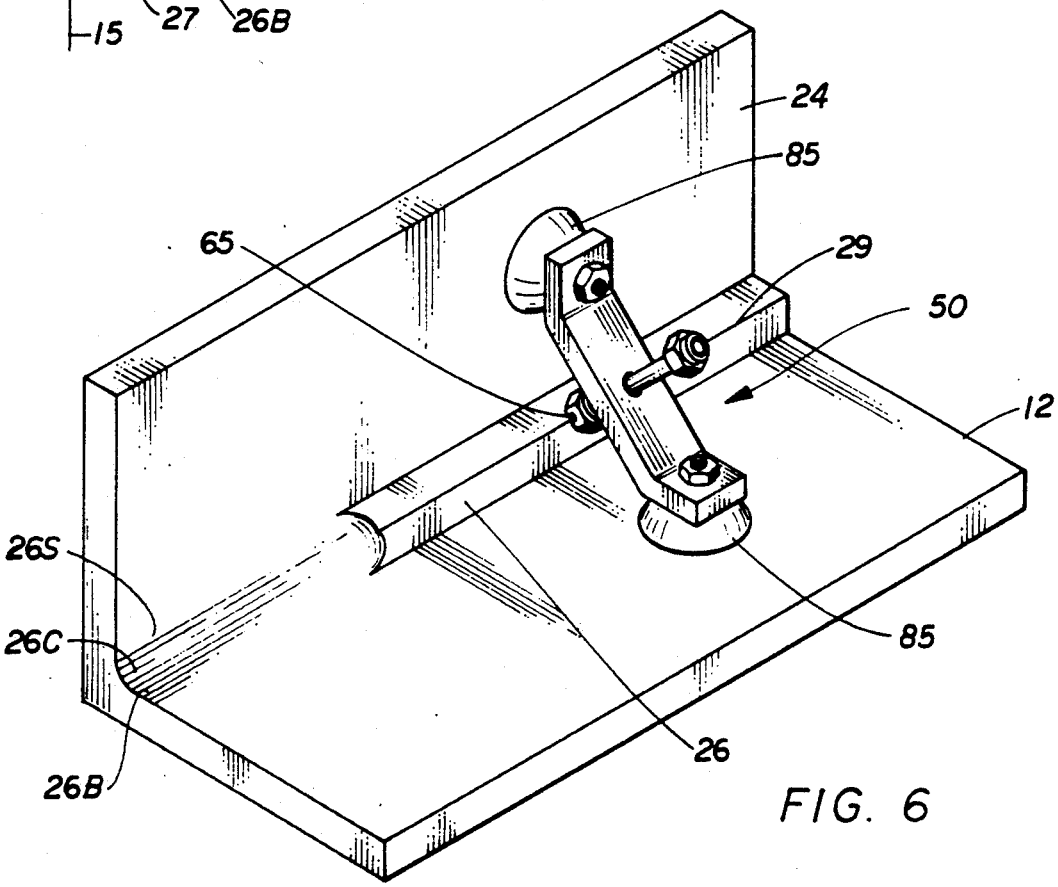
FIG. 6 is a top perspective view showing the device of this invention in use and illustrating the before and after appearance of the preparation of a cove interface according to this invention.
Figure 7:
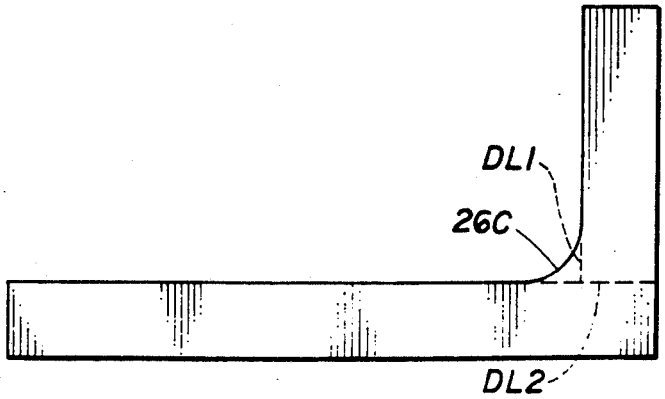
FIG. 7 is a sectional view illustrating the resulting appearance after the cove interface has been cut in the panels placed according to FIG. 5.

The reader's attention is now turned to FIG. 6 wherein the device of this invention is depicted in a top perspective view. As is seen, the device 50 is shown with one of its force cups 85 suckingly secured to the backsplash 24, while the other is similarly secured to the countertop 12. Slot 65 of the bolt rests on the right angled edge 29 of coveable stock 26, with the coil spring under compression. The disposition of the coveable stock 26 in the right side of the illustration is the same as is shown from a different angle in FIG. 5. However, the left side of the illustration shows the effect after a router has made the cove in the coveable stock. See also FIG. 7.

The cove member of the prior art technique was seen to be interposed to hold it in its position, per FIG. 1 such that once glued into place, it could be routed without being disturbed from its location. In the new technique, discussed in this application the coveable stock is smaller in depth than in the prior art procedure, and it is only glued into abutment at the interface of two panels which can be in planes generally normal, as with countertop - backsplashes, or both vertical as with shower stalls. The intended result is a tight bond of the routable stock at the interface, such that after the routing procedure, the transition's appearance from one plane to the other is smooth and uninterrupted. The desire is to achieve a one-piece continuous structure appearance.

The clamping tools of this invention are usually positioned every 5"to 10"apart. They are usually removed after the gluing step is completed, such that routing can then commence. However, it is within the scope of this invention to permit the clamping tools to remain in place during the routing step, though this is more difficult.

The use of the instant inventive device comes into play immediately after the routable stock is adhesed into position. The two force cups are optionally moistened, and then pressed into position, one on the first surface such as vertical surface 24 in FIG. 6, and one force cup is applied to the second surface such as horizontal surface 12 in that figure. The spring loaded shaft 67 is retracted slightly to orient slot 65 such that it can be aligned for placement on edge 26E, as seen in FIG. 5. After the alignment, the shaft is placed with its slot in position on edge 26E. The coil spring adds the pressure to force a tight bond of the routable stock into the desired location. Removal of the tool after adhesion is complete requires a simple hand pulling.

Routing of coveable inserts to achieve the coved effect is well known in the art. A typical coving router offered in the marketplace is sold by Art Betterley Enterprises, Inc. of Blaine, Minn. This unit will work on DuPont Corian TM and on Formica 2000X TM and other similar materials.

It has been found that in a "standard" kitchen having about 24 linear feet of countertop that it takes about 12 hours and 2× in dollars of material to prepare a coved interface, but when the tool of this invention is used for the same 24 linear feet only 1× of dollars is spent on coveable stock due to less depth—See FIGS. 1 and 2—and the time expended is only 3 to 4 hours.

On the other hand it has been found that the technique of abutting the coveable stock and using less material will not permit quality routing to transpire unless the coveable stock is held in place by the device of this invention.

It is to be understood that while the workpiece to be routed has been referred to as coveable stock, such term has only been used as the designation for illustrative purposes, because this is the preferred appearance desired for the interface of backsplashes and countertops. However other interface shapes may be prepared and are of course contemplated. The router tool employed will be the governing factor to the ultimate configuration of the interface.

It is also to be understood that the disposition of the terminal sections relative to the central section can be at angles other than a right angle. For example 30, 45 and 60 degrees. Since such a concept is easy to understand, it is believed that illustration in the drawings is not warranted. In view of the above it is obvious that there are interfaces both right angle and non-right angle, for other applications wherein the clamping tool of this invention can be employed.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A clamping tool to retain a piece of material in place during a gluing operation, which piece is to be ultimately routed and which tool comprises:

a main body comprising a central elongated section and a pair of terminal sections, and having a first planar surface and a second planar surface one terminal section being disposed at each of two opposite ends of the central section, each of said terminal sections is inwardly directed toward said first planar surface at a mirror image similar angle relative to the central section's plane of elongation;

each terminal section having a suction means attached thereto facing outwardly from said second planar surface;

and a spring-loaded notched retaining means for routable stock disposed through the central section at about the midpoint thereof with said notch facing outwardly from said second planar surface for engaging a workpiece.

2. In the clamping tool of claim 1 wherein the main body portion's terminal sections are each disposed at about a 45-degree angle relative to the central section.

3. In the clamping tool of claim 1 wherein the spring-loaded retaining means comprises a slot headed threaded pin having a coil spring thereon said notch being engageable upon said routable stock for the retention thereof.

4. In the clamping tool of claim 1 wherein the suction means disposed on each terminal section comprises a force cup having a cylindrical head wherein, said head includes an internal bore into which is secured a terminally threaded shaft, which shaft is of an extension greater than the depth of the internal bore whereby said shaft extends beyond the bore, and through the throughbore of the terminal section for retention by a nut.

5. In the clamping tool of claim 1 wherein the main body portion's terminal sections are each disposed at about a 45-degree angle relative to the central section and further wherein the spring-loaded retaining means comprises a slot headed threaded pin having a coil spring thereon said notch being engageable upon said routable stock for the retention thereof.

6. In the clamping tool of claim 1 wherein the main body portion is formed of molded plastic.

7. In the clamping tool of claim 1 wherein the two terminal sections are each disposed at an angle relative to the central section, other than at about 45 degrees.

* * * * *